US005419689A

United States Patent [19]

Holbrook

[11] Patent Number: 5,419,689

[45] Date of Patent: May 30, 1995

[54] VACUUM PUMP HAVING OIL-ACTUATED INLET VALVE

[75] Inventor: Alan E. K. Holbrook, Brighton, England

[73] Assignee: The BOC Group plc, Windlesham, England

[21] Appl. No.: 150,623

[22] Filed: Nov. 10, 1993

[30] Foreign Application Priority Data

Nov. 13, 1992 [GB] United Kingdom ..... 9223806

[51] Int. Cl.[6] ..... F04B 7/02

[52] U.S. Cl. ..... 417/507; 417/432; 137/512.5; 251/63.5

[58] Field of Search ..... 417/432, 507; 137/87, 137/107, 512.2, 512.5; 251/63.5

[56] References Cited

U.S. PATENT DOCUMENTS

| | | | |
|---|---|---|---|
| 2,383,193 | 8/1945 | Herbert | 417/507 |
| 3,027,907 | 4/1962 | Lee | 137/107 |
| 3,856,041 | 12/1974 | Cryder et al. | 137/512.2 |
| 4,328,827 | 5/1982 | Enjolras | 137/512.2 |
| 4,483,667 | 11/1984 | Berges et al. | 418/84 |
| 4,526,341 | 7/1985 | Thomas | 251/63.5 |
| 4,559,964 | 12/1985 | Yamaguchi et al. | 137/107 |
| 4,815,692 | 3/1989 | Loiseau et al. | 251/63.5 |

FOREIGN PATENT DOCUMENTS

| | | |
|---|---|---|
| 0084085 | 10/1982 | European Pat. Off. . |
| 0277924 | 2/1988 | European Pat. Off. . |
| 0355260 | 4/1989 | European Pat. Off. . |
| 511046 | 10/1930 | Germany . |
| 1195361 | 6/1970 | United Kingdom . |
| 970900 | 9/1994 | United Kingdom . |

*Primary Examiner*—Richard A. Bertsch
*Assistant Examiner*—William J. Wicker
*Attorney, Agent, or Firm*—David M. Rosenblum; Larry R. Cassett

[57] ABSTRACT

A vacuum pump which includes an oil pump for raising the pressure of oil in the vacuum pump during operation of the vacuum pump and an inlet valve for isolating the vacuum pump inlet during non-operation of the vacuum pump. The vacuum pump has an operating valve acting in an oil line between the oil pump and the inlet valve and in an oil line between the inlet valve and an oil reservoir. The operating valve is movable by means of oil pressure between a second position associated with vacuum pump operation in which the oil line between the inlet valve and the oil reservoir is closed and a first position associated with vacuum pump non-operation in which the oil line between the inlet valve and the oil reservoir is open. A means is provided to allow high pressure oil from the oil pump to communicate with the inlet valve in at least the second position.

9 Claims, 4 Drawing Sheets

VACUUM PUMP HAVING OIL-ACTUATED INLET VALVE

BACKGROUND OF THE INVENTION

This invention relates to vacuum pumps, especially to such pumps of the oil-sealed rotary type, and more particularly to mechanisms in these pumps which isolate the pump inlet from the chamber (or whatever) being evacuated by the provision of a certain design of inlet valve.

Rotary vacuum pumps of the type having a vaned rotor rotating in a pump chamber and scaled by means of scaling liquids, normally oils, are well known; these liquids also act as lubricants and coolants for the pump. However, there is a possibility when such pumps are turned off that the oil (or process gas) can contaminate the vacuum chamber or vacuum system associated with the pump.

With such pumps there is a danger of the oil (or its vapors) or the process gas being sucked back into the vacuum system associated with the pump when the pump is turned off. Although this danger can be eliminated by ensuring that all the possible routes into the pump are leak tight, it is often difficult to achieve this readily.

The use of an inlet valve for the pump is known which closes the inlet when the pump is tamed off to prevent the oil (or its vapors) or the process gas from passing out of the inlet to the vacuum system by "suck back".

An inlet valve that can close over the pump inlet is the most direct manner of scaling off the inlet. However, these valves are commonly unreliable, especially if the oil is contaminated by constituents of the substance being pumped, as they are generally operated by a continuous flow of oil past tight diametrical clearances in the valve mechanism which act as a sieve and tend to collect particles of dirt, leading to a seizure of a valve piston or prevention of complete valve closure. Furthermore, such valves also tend to be relatively complicated and therefore expensive to install in the pumps.

The necessary pressure of oil in the pump required for efficient operation is provided by an oil pump associated with the vacuum pump itself.

Commonly the oil pump is contained within the vacuum pump housing and may be driven by the same motor (often by the same shaft rotated by the motor) used to operate the vacuum pump.

SUMMARY OF THE INVENTION

The present invention is concerned with the provision of a new design of inlet valve mechanism for a vacuum pump which is generally reliable, fast acting particularly when the pump is turned off, and of simple construction. Its mechanism is generally operated to hold the inlet valve closed by means of a spring and opened by the pressure of oil in the system, thereby providing a positive action mechanism.

In accordance with the invention, there is provided a vacuum pump which includes an oil pump for raising the pressure of oil in the vacuum pump during operation of the vacuum pump and an inlet valve for isolating the vacuum pump inlet during non-operation of the vacuum pump, wherein the vacuum pump has an operating valve acting in an oil line between the oil pump and the inlet valve and in an oil line between the inlet valve and an oil reservoir, the operating valve being movable by means of oil pressure between a second position associated with vacuum pump operation in which the oil line between the inlet valve and the oil reservoir is closed and a first position associated with vacuum pump non-operation in which the oil line between the inlet valve and the oil reservoir is open and wherein means are provided to allow high pressure oil from the oil pump to communicate with the inlet valve in at least the second position.

Commonly the communication between the high pressure oil from the oil pump and the inlet valve is caused by allowing oil to seep past the operating valve in the second position and, preferably, also in the operating valve first position. Alternatively, especially with a diaphragm operating valve, a separate form of communication can be employed, for example a separate by-pass line, preferably including a fluid restrictor therein.

Generally, the invention is particularly suitable for use in oil-scaled vacuum pumps and the oil pump is designed to be operational when the vacuum pump is on and non-operational when the vacuum pump is off and the difference in oil pressure to be operational in effecting the operating valve movement.

In preferred embodiments, the operating valve is designed such that, in its second position with the oil line between the oil pump and inlet valve open, the oil passageway past the operating valve member is restricted such that, in use, the oil seeps past the valve member. Preferably also, the operating valve member is biased towards the first position so that the first position is automatically adopted when the oil pump is off.

The operating valve design can be varied to suit the needs of any particular vacuum pump. For example, it could comprise a cylinder or "cup-shaped" member slidable within a chamber, one end of which can communicate, and can seal, with the oil line from the oil pump and the other end of which can communicate, and can seal the oil line to the oil reservoir.

Alternatively the operating valve member could be a diaphragm operating in the line from the oil pump; however, this alternative would in general necessarily include a separate "by pass" line between the oil pump and the inlet valve, preferably very restricted in size, or containing a restrictor therein, operating to communicate oil pump high pressure to the inlet valve with the diaphragm in the second position.

The vacuum pump preferably also has a relief valve to regulate the pressure of oil in the vacuum pump within predetermined limits. This relief valve can advantageously be positioned in an oil line between the oil pump and the oil reservoir such that in a first position it prevents communication between the oil pump and the reservoir but that, once the predetermined higher pressure has been achieved by the oil pump, it moves to a second position and allows such communication until the predetermined pressure is achieved. In practice during use of the vacuum pump, the relief valve member tends initially to oscillate close to its second position and thereafter to establish a substantially fixed location close to the second position such that the required pressure is achieved.

In preferred embodiments, the operating valve and the relief valves can be amalgamated. In certain designs, the relief valve member is preferably slidably contained within the operating valve.

It has been found that with the vacuum pumps of the invention, in particular, with a restricted flow past the operating valve, that the inlet valve is caused to move very quickly from its open (in use) position to its closed position once the vacuum pump, and hence the oil pump, has stopped.

BRIEF DESCRIPTION OF THE DRAWINGS

For a better understanding of the invention, reference will now be made, by way of exemplification only, to the accompanying drawings in which.

DETAILED DESCRIPTION

Figure 1:
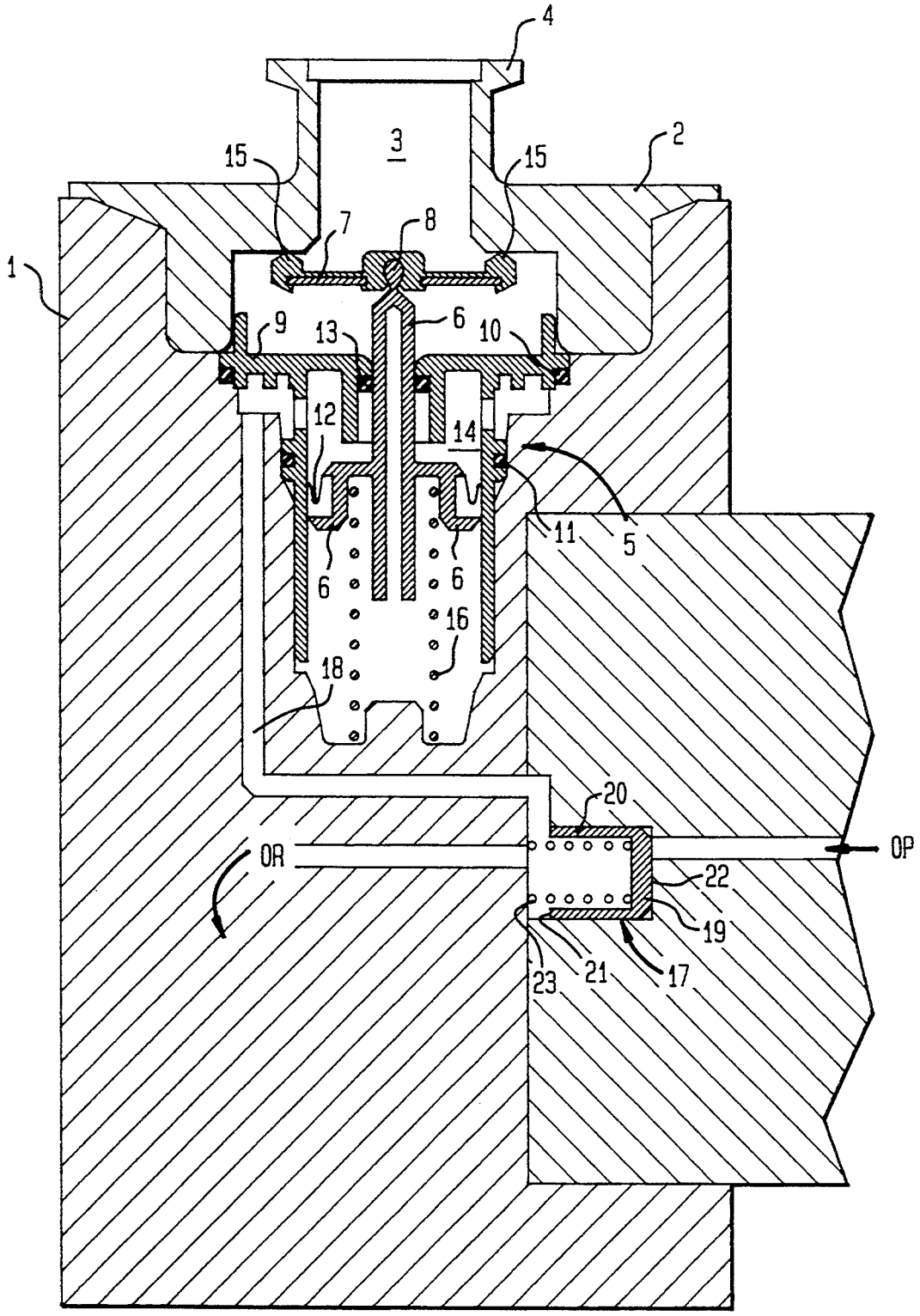
FIG. 1 shows a schematic sectional view of that part of a vacuum pump of the invention showing the inlet valve and an operating valve.

With reference to the drawings and FIG. 1 in particular, there is shown a rotary vacuum pump with a body 1 having sealingly connected thereto a pump inlet portion 2 defining an inlet 3 which, in use of the vacuum pump, is connected by means of a circular flange 4 to a vacuum system.

In normal use of the vacuum pump, material being evacuated from the vacuum system to which the vacuum pump is attached passes into the pump via the inlet 3 and exhausts from the pump via an outlet (not shown). An inlet valve generally indicated at 5 is provided to isolate the inlet 3 during non-operation of the vacuum pump. The inlet valve 5 comprises a valve member 6 having a circular valve head portion 7 attached thereto by means of a ball joint at 8.

A further body portion 9 of generally cylindrical shape is fixed within the main body 1 and sealed thereto by means of 'O' rings 10, 11. The body portion 9 has a centrally located aperture for receiving the valve member 6. The member 6 is arranged to be slidable within the body portion 9; seals in the form a) of a sliding "U" seal 12 (alternatively a diaphragm could be used) linking the body portion 9 and the member 6 and b) an 'O' ring seal 13 form a cavity 14 between the body portion 9 and the member 6.

The valve head portion 7 is designed to be seated on an annular seat 15 formed on the lower (as shown) surface of the inlet portion 2; accurate seating between the head portion 7 and the seat 15 is aided by the ball joint 8 which allows relative movement between the valve member 6 and the head portion 7.

In FIG. 1, the inlet valve is shown in the closed position. In general the inlet valve is biased towards the closed position by means of a spring 16.

Actuation of the inlet valve 5 is effected by means of an operating valve 17 positioned in oil lines linking an oil pump (OP), line 18 to the inlet valve and an oil reservoir or sump (OR).

The operating valve in the simple form shown in FIG. 1 comprises a circular cross-section, "cup-shaped" valve member 19 slidable with a cylindrical chamber 20 formed in the pump body. The member 19 has an annular seal 21 on the annular top lip of the "cup" but oil from the line OP is allowed to seep past the base 22 and the side walls of the "cup"; in a second position of the member 19 associated with pump operation the seal 21 is seated about the oil line OR and seals the oil reservoir (not shown) from the inlet valve line 18 and in a first position of the member 19 (as shown in FIG. 1) the base 22 still allows oil from the oil line OP to flow past it and the "cup" generally but in this first position oil can flow readily from the inlet valve via the line 18 to the oil reservoir via the oil line OR.

Generally, the relative dimensions and shape of the member 19 and the chamber 20 allows for a restricted amount of oil to pass therebetween at all times. A spring 23 is present to bias the valve member 19 towards the first position associated with pump non-operation.

The rotary pump mechanism is not shown in the drawings. However, as is common in pumps of this type, the vacuum pump and its oil pump are operated by the same drive so that the oil pump is on when the vacuum pump is on.

When the vacuum pump, and hence the oil pump, is off, there is no high pressure oil in line OP and the valve member 19 adopts its first position (as shown in FIG. 1) by virtue of the force exerted on it by the spring 23. Any oil in the line 18 can pass via the line OR to the oil reservoir. The spring 16 exerts a pressure on the valve member 6, thereby keeping the inlet valve 5 closed at the seat 15 and hence isolating the vacuum system to which the vacuum pump is attached from the vacuum pump mechanism.

When the vacuum pump, and hence the oil pump, is turned on, higher pressure oil in the line OP acts on the valve member 19 and overcomes the force exerted by the spring 23 and the member 19 adopts its second position in which the seal 21 is seated about the oil line OR and thereby closes the line OR.

High pressure oil from the line OP then seeps passed the valve member 19 and pressurizes the line 18 and the cavity 14, thereby exerting a downward (as shown) pressure on the valve member 6 and overcoming the force exerted by the spring 16. The inlet valve 5 therefore opens.

When the vacuum pump/oil pump has been mined off, pressure falls in the line OP and the valve member 19 moves from its second to its first position. The link between the line OR and the line 18 opens to allow a very rapid "dumping" of oil from the inlet valve which causes the inlet valve to close under the pressure exerted on the valve member 6 by the spring 16.

In general in vacuum pumps of this type, means are provided to control the pressure of the oil in the vacuum pump as a whole. In preferred embodiments of the invention, such means are associated with the operating valve and are advantageously in the form of a pressure relief valve.

Figure 2:
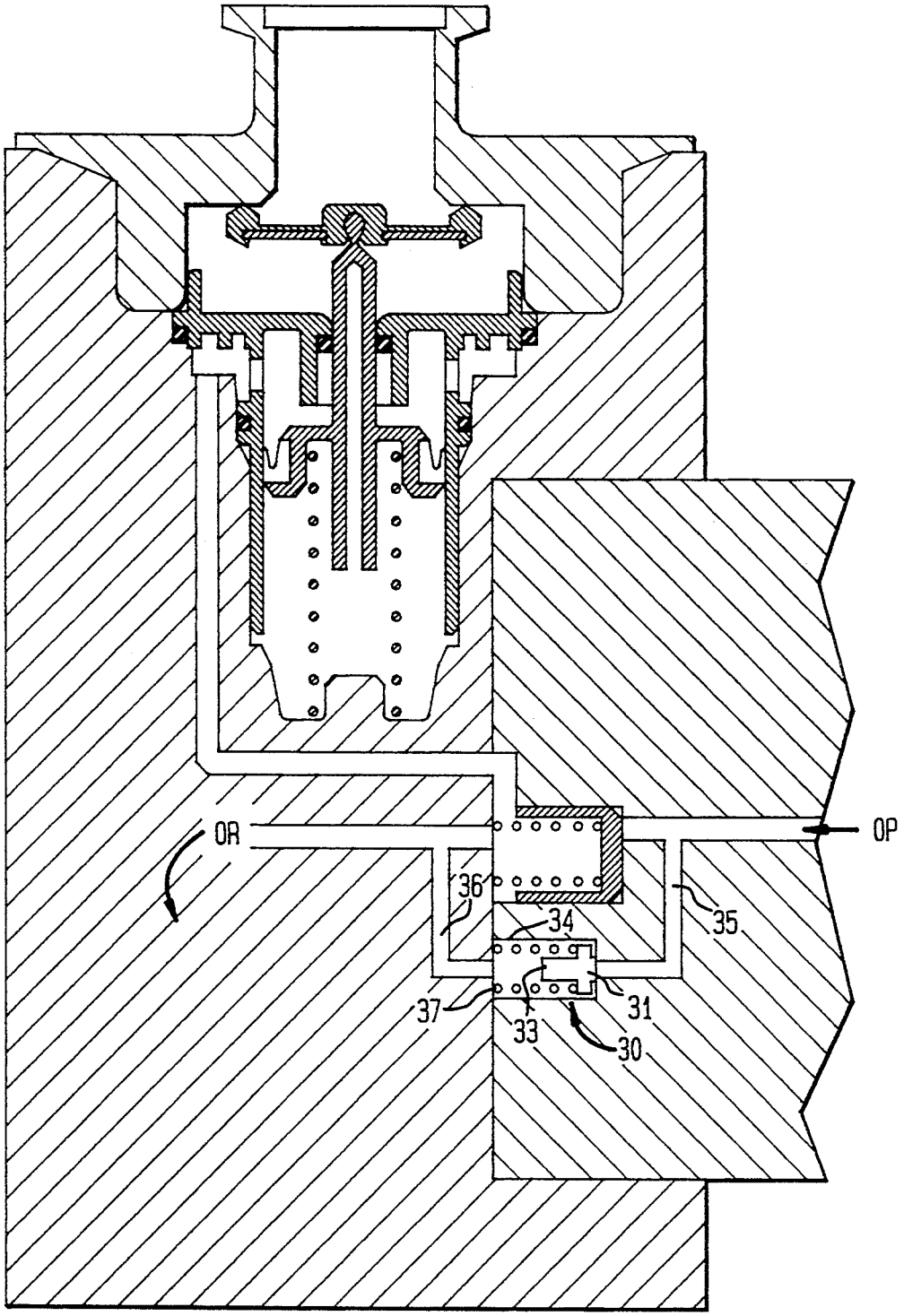
FIG. 2 shows a similar sectional view to that of FIG. 1 showing the same part of a vacuum pump of the invention showing the inlet valve and separate operating and relief valves.

An arrangement showing such a pressure relief valve is shown in FIG. 2. The relief valve 30 comprises a relief valve member 31 of generally cylindrical shape and having an annular seal 32 on one end and a circular sealing surface 33 on the other end. The member is slidable within a cylindrical chamber 34 in the vacuum pump body, the chamber 34 being linked via an oil line 35 to the oil line OP from the oil pump and via an oil line 36 to the oil line OR and hence to the oil reservoir. The size of the member 31 in relation to the chamber 34 is such that it can seep passed the member if neither end of the member is sealed.

A spring 37 biases the member 31 towards seating the seal 32 about the line 35. When the vacuum pump/oil pump is turned on and the lines OP and 35 are gradually pressurized, the seal 32 of the member 31 continues to seal the line 35 until such time as the oil pressure overcomes the force exerted by the spring 37. When this pressure is reached (predetermined by the force exerted by the spring), the valve member 31 moves so that the seal 32 no longer seals the line 35 and excess oil pressure above the predetermined level can be relieved by allowing oil to pass the member 31 and into the line 36 and hence into the line OR to the oil reservoir. When the excess oil pressure in the vacuum pump has been removed the valve member 31 can return to its original position and seal the line 35.

In normal use, it is likely that the member 31 will "hover" within, and finally adopt a set position in, the chamber 34 so that a predetermined pressure range in the vacuum pump is achieved.

Figure 3:
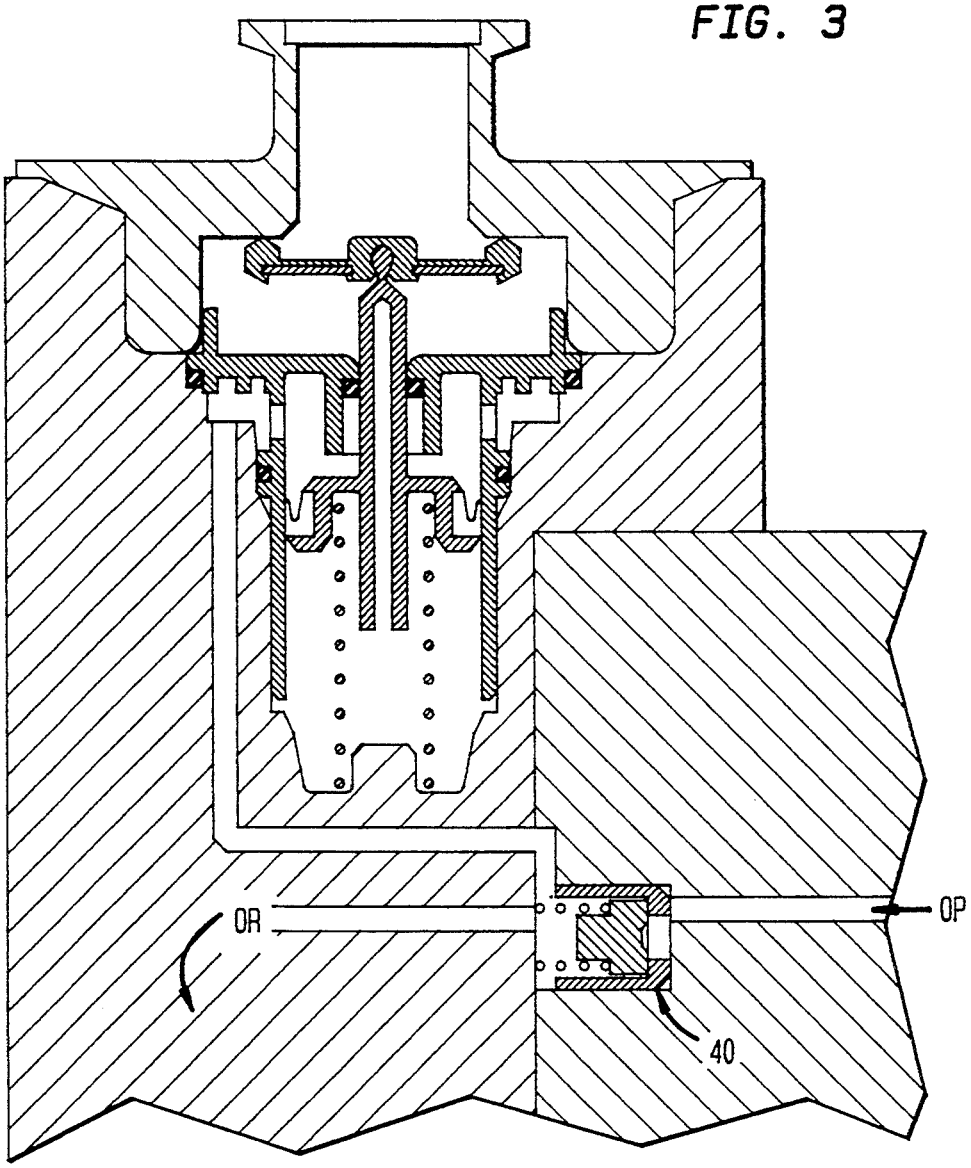
FIG. 3 shows a similar sectional view of that part of a vacuum pump of the invention showing the inlet valve and combined operating/relief valves.
Figure 3A:
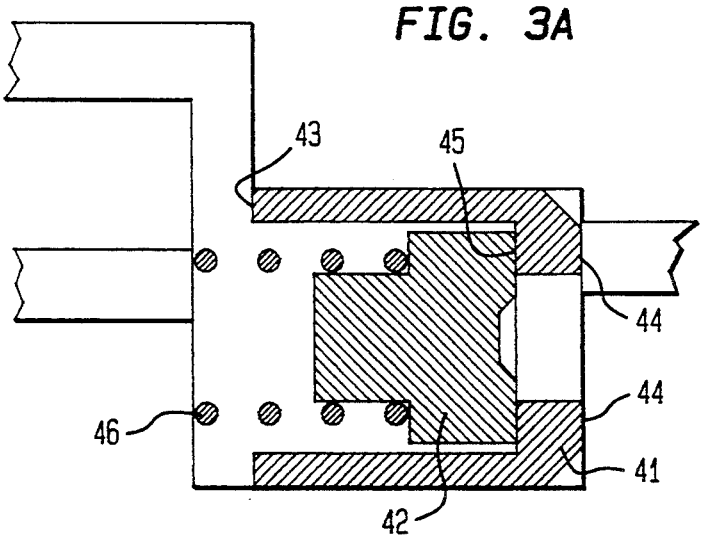
FIG. 3A is an enlarged, fragmentary view of FIG. 3 illustrating a combined operating valve and pressure relief valve shown in FIG. 3.

Turning to FIG. 3 and 3A this shows the same arrangement of inlet valve as shown in FIGS. 1 and 2 but with a combined operating valve and pressure relief valve shown generally at 40. With particular reference to the enlargement of the combined valve arrangement indicated by the arrow 'E', there is shown a hollow, substantially cylindrical valve member 41 operating in essentially the same manner as the cup-shaped valve member 19 of FIGS. 1 and 2. Contained within the member 19, however, is a relief valve member 42 which is slidable within the member 19 and operates in essentially the same manner as the member 31 in FIG. 2.

As before, there is a seal on an annular end 43 of the member 41 and, although the annular end 44 can abut a stop in the line OP, oil can (as before) still seep past the member 41.

In operation of the combined valve, the valve members 41, 42 are in the positions shown in FIG. 3 when the vacuum pump/oil pump is off. The member 42, and hence member 41 are biased towards these positions by means of the spring 46. When the oil pump is turned on, the higher pressure in the line OP causes both the member 41, 42 to move to the left (with respect to FIG. 3) and for the end 44 to leave its stop, thereby closing the line OR and allowing the line 18 (see FIG. 1) to be pressurized and to operate the inlet valve opening as described previously.

The member 42 can independently act as the pressure relief valve and leave its seat at 45 when the pressure in line OP increases above a predetermined maximum, thereby allowing oil to pass between the exterior of the member 42 and the interior of the member 41.

An advantage of the combined design is that the pressures at which the operating valve and relief valve move are held in a fixed ratio by the geometry of the components (valve members) and independent of the stiffness of the spring 46.

Figure 4:
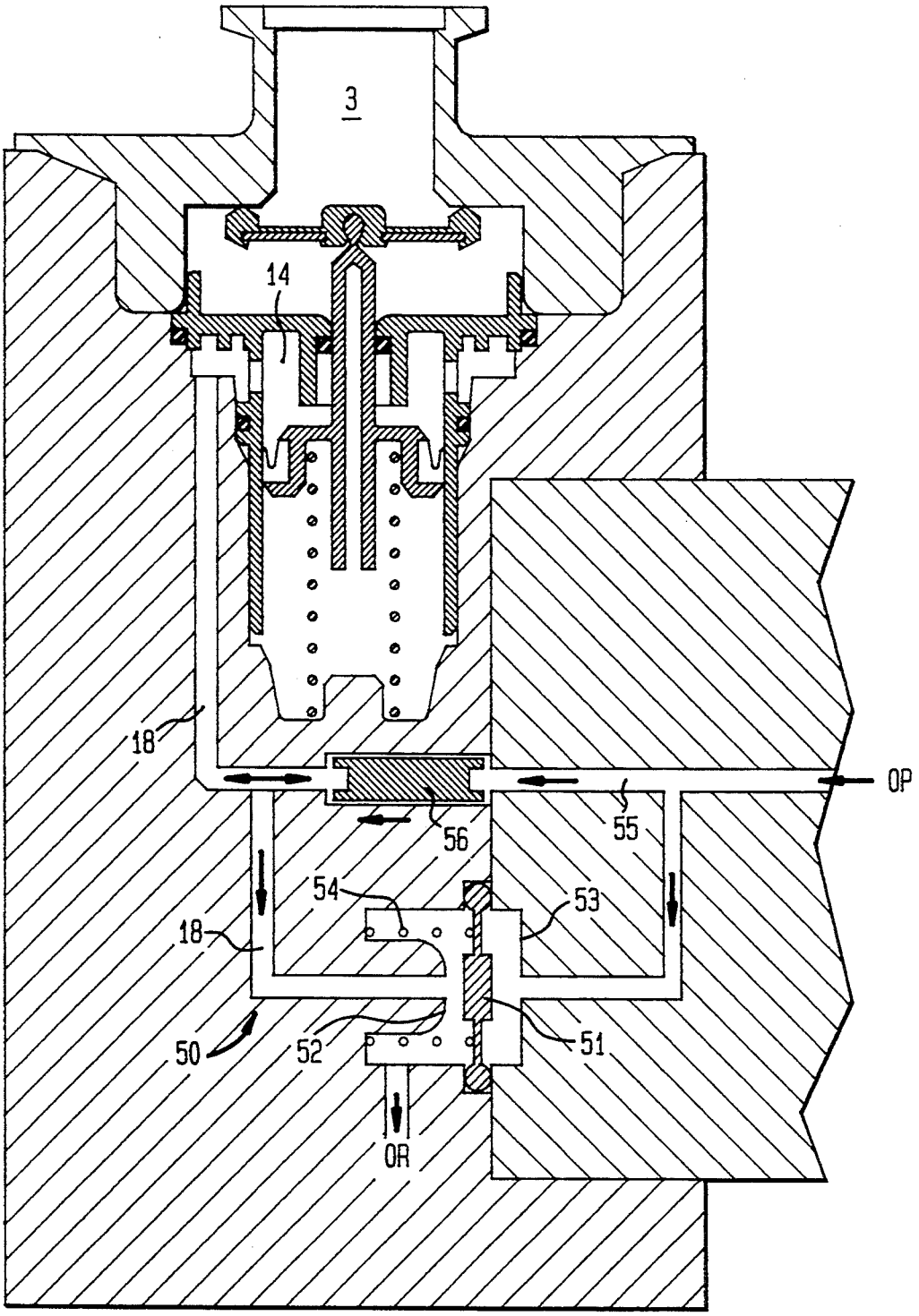
FIG. 4 shows a similar sectional view to that of FIGS. 1, 2 and 3 showing the same part of a vacuum pump but having a diaphragm operating valve with a by pass restrictor.

Turning to FIG. 4, this shows an operating valve generally indicated at 50 for an inlet valve arrangement of exactly the same type as shown in the previous drawings. The operating valve 50 comprises a diaphragm 51 which is positioned between the line OP on the one side and the lines OR and 18 on the other and blocking the flow of oil between the respective sides.

The diaphragm acts as a valve member and can seal the opening of the line OR at 52 in the second position. In the first position associated with pump non-operation, a spring 54 biases the diaphragm towards the stop at 53.

A by-pass oil line 55 links the line OP and the line 18 and by-passing the chamber in the valve body containing the diaphragm 51. Within the line 55 is a restrictor 56 for limiting (but not preventing) the passage of oil therethrough. The restrictor 56 is relatively long to retain pressure generally.

In use of this embodiment, the position of the diaphragm with the vacuum pump/oil pump off is shown in FIG. 4. When the pumps are turned on, the diaphragm is moved against the force exerted by the spring 54 to seal the oil line OR at 52 by virtue of the initial higher pressure in the line OP.

Thereafter in the pump second position, the diaphragm continues to seal the line OR by virtue of an area difference across the diaphragm 51. Simultaneously high pressure oil flow through the line 55 past the restrictor 56 and into the chamber 14 to open the inlet valve 3 as previously described.

When the pumps are turned off, the lower pressure in the line OP causes the diaphragm to leave its seat at 52 and allow a very rapid "dumping" of oil from the chamber 14 to the oil reservoir via the line OR.

I claim:

1. A vacuum pump including: a vacuum pump inlet; an oil reservoir; an oil pump for raising oil pressure of oil in the vacuum pump during operation of the vacuum pump; an inlet valve having a closed position for isolating the vacuum pump inlet during non-operation of the vacuum pump and an oven position for opening the vacuum pump inlet during operation of the vacuum pump; the inlet valve configured to be actuated by the raised pressure oil produced by said oil pump to assume said open position; two oil lines connected to form two flow paths for said oil; one of the two flow paths communicating between the oil pump and the inlet valve; and the other of the two flow paths communicating between the inlet valve and the oil reservoir; an actuable operating valve acting in the two oil lines; the operating valve actuated by oil pressure between a first position, associated with vacuum pump non-operation, in which the other of the two flow paths communicating between the inlet valve and the oil reservoir is open, thereby to allow oil to flow from said inlet valve to said reservoir and a second position, associated with vacuum pump operation, in which the other of the two flow paths communicating between the inlet valve and the oil reservoir is closed, thereby to allow said raised pressure oil from the oil pump to flow to the inlet valve.

2. The vacuum pump according to claim 1 in which said operating valve is configured such that oil flows past said operating valve to flow within said one flow path when said operating valve is in said second position.

3. The vacuum pump according to claim 1 in which the operating valve is a diaphragm valve.

4. The vacuum pump according to claim 1 in which communication between the high pressure oil from the oil pump and the inlet valve comprises a by-pass line to the operating valve.

5. The vacuum pump according to claim 4 in which the by-pass line has a fluid restrictor therein.

6. The vacuum pump according to claim 1 further including means for biasing the operating valve towards the first position.

7. The vacuum pump according to claim 1 which also includes a relief valve to regulate the pressure of oil in the vacuum pump within predetermined limits.

8. The vacuum pump according to claim 7 in which the operating valve and the relief valve are amalgamated.

9. The vacuum pump according to claim 8 in which the relief valve is slidably contained within the operating valve.

* * * * *